US010211499B2

(12) United States Patent
Peng et al.

(10) Patent No.: US 10,211,499 B2
(45) **Date of Patent: *Feb. 19, 2019**

(54) FOUR-MODE DEFECTED GROUND STRUCTURE RESONATOR

(71) Applicant: QINGDAO HAIER ELECTRONICS CO., LTD., Shandong (CN)

(72) Inventors: Biao Peng, Shandong (CN); Shufang Li, Shandong (CN); Shuai Wang, Shandong (CN); Ling Wang, Shandong (CN); Yili Zhai, Shandong (CN); Xijia Hu, Shandong (CN)

(73) Assignee: QINDAO HAIER ELECTRONICS CO., LTD., Shandong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/386,173

(22) Filed: Dec. 21, 2016

(65) Prior Publication Data

US 2017/0237138 A1 Aug. 17, 2017

(30) Foreign Application Priority Data

Feb. 16, 2016 (CN) ..... 2016 1 0087273

(51) Int. Cl.

| | |
|---|---|
| ***H01P 1/203*** | (2006.01) |
| ***H01P 3/08*** | (2006.01) |
| ***H01P 7/08*** | (2006.01) |
| ***H01P 1/201*** | (2006.01) |
| ***H01P 3/02*** | (2006.01) |
| ***H01Q 1/38*** | (2006.01) |

(52) U.S. Cl.

CPC ..... *H01P 1/20381* (2013.01); *H01P 1/203* (2013.01); *H01P 1/2016* (2013.01); *H01P 3/023* (2013.01); *H01P 3/08* (2013.01); *H01P 3/081* (2013.01); *H01P 7/08* (2013.01); *H01P 7/082* (2013.01); *H01Q 1/38* (2013.01)

(58) Field of Classification Search

CPC ..... H01P 1/203; H01P 1/20381; H01P 3/08; H01P 3/081; H01P 7/08; H01P 7/082

USPC ..... 333/204, 205, 219, 238, 246

See application file for complete search history.

(56) References Cited

U.S. PATENT DOCUMENTS

2010/0009854 A1* 1/2010 Sato ..... H01P 1/20381 505/210

OTHER PUBLICATIONS

Ghoname et al.; "Novel Compact Spider Microstrip Antenna with New Defected Ground Structure"; Sep. 2012.*

* cited by examiner

*Primary Examiner* — Rakesh Patel

(74) *Attorney, Agent, or Firm* — Dilworth IP, LLC

(57) ABSTRACT

The present invention discloses a four-mode defected ground structure resonator, comprising a metal dielectric substrate and a defected ground unit which is etched in one surface of the metal dielectric substrate; the shape of the defected ground unit is axially symmetric about a first central axis of the defected ground unit, and also the shape of the defected ground unit is axially symmetric about a second central axis of the defected ground unit; the first defected ground unit is provided with H-shape or quasi H-shape, the second defected ground unit is provided with L-shape, quasi L-shape, U-shape or quasi U-shape. The four-mode defected ground structure resonator of the present invention is provided with four types of resonant modes, and the four types of resonant modes are provided with good tunability.

10 Claims, 9 Drawing Sheets

FOUR-MODE DEFECTED GROUND STRUCTURE RESONATOR

TECHNICAL FIELD

The present invention relates to the field of resonator technologies, and in particular to a four-mode defected ground structure resonator.

BACKGROUND

A resonator could produce resonant frequency. In a modern microwave communication system, defected ground structure resonators (DGSR) have many advantages, however, the resonant modes of the existing defected ground structure resonator are too few, and the tunability of the resonant modes is poor.

SUMMARY

Object of the present invention is to provide a four-mode defected ground structure resonator, so that four resonant modes of the resonator are provided with good tunability.

Technical solutions of the present invention are as follows.

A four-mode defected ground structure resonator includes a metal dielectric substrate and a defected ground unit which is etched in one surface of the metal dielectric substrate, where shape of the defected ground unit is axially symmetric about a first central axis of the defected ground unit, and is axially symmetric about a second central axis of the defected ground unit, and the first central axis and the second central axis are mutually perpendicular; the defected ground unit includes a first defected ground unit and four second defected ground units, where the first defected ground unit is provided with H-shape or quasi H-shape, the second defected ground unit is provided with L-shape, quasi L-shape, U-shape or quasi U-shape, one end of each of the four second defected ground units is connected to four ends of the first defected ground unit respectively, each of the second defected ground units extends to the first central axis and bends to center of the defected ground unit, openings of the four second defected ground units with the L-shape, quasi L-shape, U-shape or quasi U-shape all face to periphery of the defected ground unit; and, there is a space provided between the two second defected ground units located at a same side of the first central axis or a second central axis.

Further, the first defected ground unit is formed by a first slot line, a second slot line and a third slot line; one end of the first slot line is connected to a middle part of the second slot line, the other end of the first slot line is connected to a middle part of the third slot line; and the second slot line and the third slot line are parallel to each other and both are perpendicular to the first slot line.

Further, when the second defected ground unit is provided with U-shape or quasi U-shape, the second defected ground unit includes a fourth slot line, a fifth slot line and a sixth slot line, where, one end of the fourth slot line is connected to any end of the second slot line or the third slot line and extends to the first central axis; the other end of the fourth slot line is connected to one end of the fifth slot line, the other end of the fifth slot line is connected to one end of the sixth slot line and extends to the second central axis; and, the fourth slot line and the sixth slot line are parallel to each other and both are perpendicular to the fifth slot line.

Further, length of the sixth slot line is shorter than that of the fourth slot line.

Further, a first electrode plate is formed by the metal dielectric substrate enclosed by part of the first slot line, the second slot line or the third slot line located at a same side of the first slot line, the fourth slot line, the fifth slot line and the sixth slot line, where, the first electrode plate is provided with L-shape, number of first electrode plates is two, and two first electrode plates are axially symmetric about the first central axis; a second electrode plate is formed by the metal dielectric substrate enclosed by part of the first slot line, the second slot line or the third slot line located at another side of the first slot line, the fourth slot line, the fifth slot line and the sixth slot line, where, the second electrode plate is provided with L-shape, number of second electrode plates is two, and two second electrode plates are axially symmetric about the first central axis.

Further, the metal dielectric substrates which are provided between part of the first slot line and the sixth slot line form a first inductor $L_S$, and number of first inductors is four; the two metal dielectric substrates, which locate at a same side of the first slot line and form two of the first inductors $L_S$ respectively, are interconnected to each other; the metal dielectric substrate forming the first electrode plate and the metal dielectric substrates forming the first inductor $L_S$ and located at a same side of the first central axis are interconnected to each other; and the metal dielectric substrate forming the second electrode plate and the metal dielectric substrates forming the first inductor $L_S$ and located at a same side of the first central axis are interconnected to each other.

Further, the metal dielectric substrates located between two fifth slot lines at a same side of the first slot line form a second inductor $L_P$, and number of second inductors LP is two; two metal dielectric substrates respectively forming two first inductors $L_S$ and the metal dielectric substrates forming second inductors $L_P$ and located at a same side of the first slot line are interconnected to each other, and form a shape of T.

Further, the metal dielectric substrates located at periphery of the defected ground unit form a metal ground plane, and the metal dielectric substrates forming the metal ground plane are interconnected to the metal dielectric substrates forming second inductors $L_P$.

Further, a first capacitor $C_M$ is formed by the first electrode plate and the second electrode plate which are located at a same side of the first central axis, a second capacitor $C_C$ is formed between the metal ground plane and the first electrode plate or the second electrode plate.

Further, resonant frequency of a first resonant mode of the four-mode defected ground structure resonator is $$f_1 = \frac{1}{2\pi\sqrt{(L_S + 2L_P)(2C_M + C_C)}};$$

resonant frequency of a second resonant mode of the four-mode defected ground structure resonator is $$f_2 = \frac{1}{2\pi\sqrt{(L_S + 2L_P)C_C}};$$

resonant frequency of a third resonant mode of the four-mode defected ground structure resonator is $$f_3 = \frac{1}{2\pi\sqrt{L_S(2C_M + C_C)}};$$

and, resonant frequency of a fourth resonant mode of the four-mode defected ground structure resonator is $$f_4 = \frac{1}{2\pi\sqrt{L_S C_C}}.$$

Compared to the prior art, the present invention is provided with the following advantages:

the four-mode defected ground structure resonator has four types of resonant modes, furthermore, four resonant modes are all provided with good tunability.

DETAILED DESCRIPTION

Figure 1:
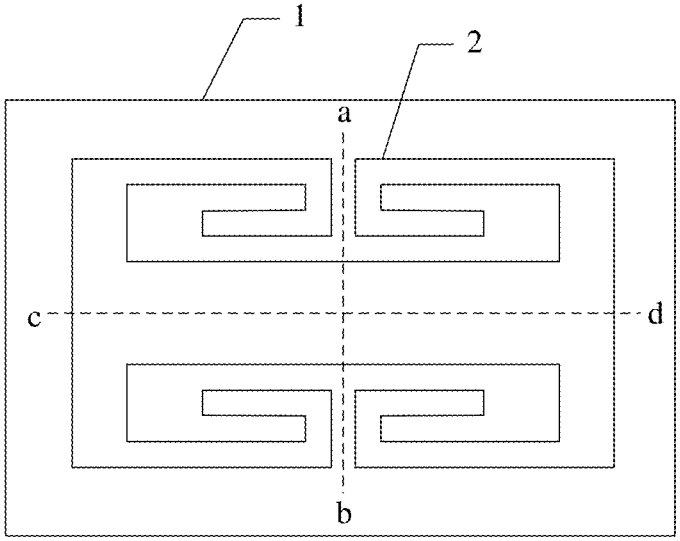
FIG. 1 is a first schematic structural diagram illustrating a four-mode defected ground structure resonator according to an embodiment of the present invention.
Figure 2:
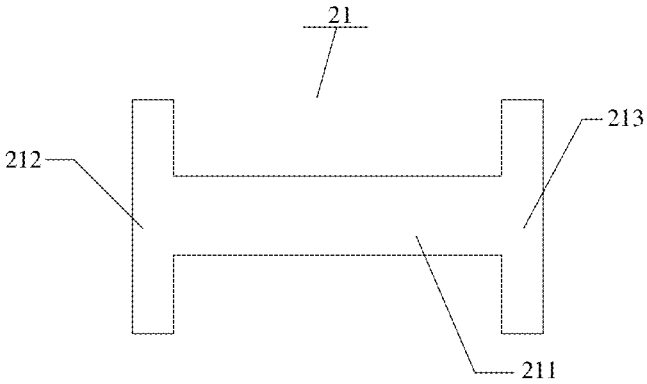
FIG. 2 is a schematic structural diagram illustrating a first defected ground unit of a four-mode defected ground structure resonator according to an embodiment of the present invention.
Figure 3:
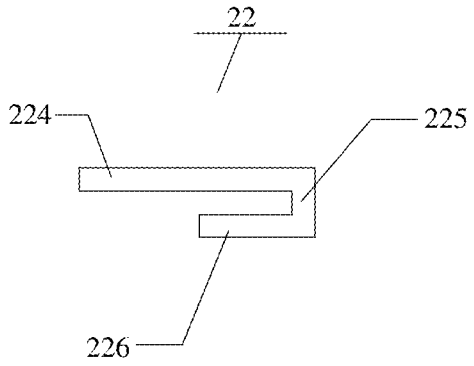
FIG. 3 is a schematic structural diagram illustrating a second defected ground unit of a four-mode defected ground structure resonator according to an embodiment of the present invention.
Figure 4:
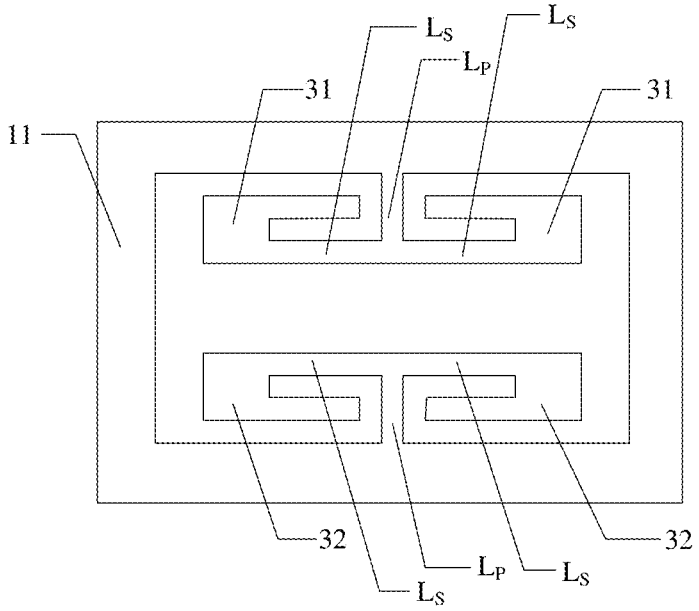
FIG. 4 is a second schematic structural diagram illustrating a four-mode defected ground structure resonator according to an embodiment of the present invention.
Figure 5:
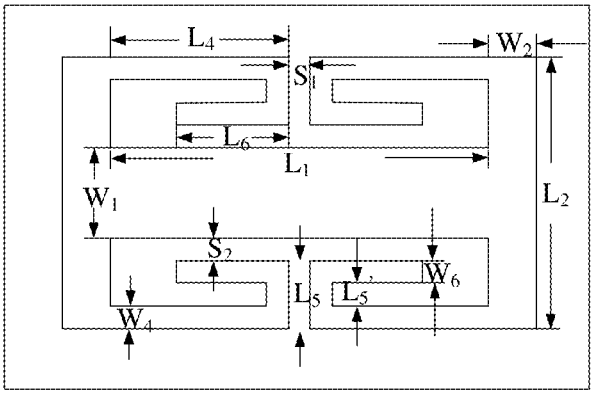
FIG. 5 is a third schematic structural diagram illustrating a four-mode defected ground structure resonator according to an embodiment of the present invention.

In order to obviously understand the above mentioned objects, features and advantages of the present invention, descriptions will be given in more detail with reference to the drawings and embodiments.

The present invention discloses a four-mode defected ground structure resonator. As shown in FIG. 1 to FIG. 5, respectively, they are the first schematic structural diagram of the four-mode defected ground structure resonator, the schematic structural diagram of the first defected ground unit, the schematic structural diagram of the second defected ground unit, the second schematic structural diagram of the four-mode defected ground structure resonator and the third schematic structural diagram of the four-mode defected ground structure resonator according to embodiments of the present invention.

Where, the four-mode defected ground structure resonator includes a metal dielectric substrate 1 and a defected ground unit 2 which is etched in one surface of the metal dielectric substrate 1. The shape of the defected ground unit 2 is axially symmetric about a first central axis ab of the defected ground unit 2, and also the shape of the defected ground unit 2 is axially symmetric about a second central axis cd of the defected ground unit 2, and the first central axis ab and the second central axis cd are mutually perpendicular. In the present invention, the first central axis ab is defined to be a central axis that can divide the H-shaped or quasi H-shaped structure into the left and right halves (after dividing into the two halves, each portion is T-shape or quasi T-shape), and the second central axis cd is defined to be a central axis that can divide the H-shaped or quasi H-shaped structure into the upper and lower halves (after dividing into the two halves, each portion is U-shape or quasi U-shape). Specifically, the defected ground unit 2 includes a first defected ground unit 21 and four second defected ground units 22, where the first defected ground unit 21 is provided with H-shape or quasi H-shape. The quasi H-shape defined in the present invention refers to a shape similar to H-shape as a whole. The second defected ground units 22 are provided with L-shape, quasi L-shape, U-shape or quasi U-shape. The quasi L-shape defined in the present invention refers to a shape similar to L-shape as a whole, for example, one free end of the L-shape (i.e. not the end connected to the first defected ground unit 21) may be bended for very small section, the very small section may be very short compared to the length of the side where the free end is located. The quasi U-shape defined in the present invention refers to a shape similar to U-shape as a whole, for example a shape that one side where one end of the U-shape is located may be shorter than the other side where the other end of the U-shape is located. For example, one free end of the U-shape (i.e. not the end connected to the first defected ground unit 21) may be bended for at least one more time, the length of the bending section after being bended every time may be very short compared to the length of the side where the free end is located, thus making the shape remain similar to U-shape as a whole without bring out significant affect to the performance of the second defected ground unit 22. One end of each of the four second defected ground unit 22 is connected to the four ends of the first defected ground unit 21 respectively, each of the second defected ground unit 22 extends to the first central axis ab and bends to the center of the defected ground unit 2, and number of the bending times is two. Openings of four second defected ground 2 with L-shaped, quasi L-shaped, U-shaped or quasi U-shaped all face to periphery of the defected ground unit, and, there is a space provided between the two second defected ground unit 22 located at a same side of the first central axis ab or the second central axis cd.

The above mentioned defected ground unit 2 is provided with a longitudinal symmetrical and bilateral symmetrical structure, thus the four-mode defected ground structure resonator is provided with four resonant modes at a same time, and also resonant frequency of each resonant mode can be provided with good tunability.

Specifically, the first defected ground unit 21 is formed by a first slot line 211, a second slot line 212 and a third slot line 213. One end of the first slot line 211 is connected to the middle part of the second slot line 212, and the other end of the first slot line 211 is connected to the middle part of the third slot line 213. The second slot line 212 and the third slot line 213 are parallel to each other and both are perpendicular to the first slot line 211. Therefore, the first slot line 211, the second slot line 212 and the third slot line 213 form an H-shape or quasi H-shape.

Specifically, if the second defected ground unit 22 is provided with U-shape or quasi U-shape, the second defected ground unit 22 includes a fourth slot line 224, a fifth slot line 225 and a sixth slot line 226. One end of the fourth slot line 224 is connected to any end of the second slot line 212 or the third slot line 213 and the fourth slot line extends to the first central axis ab, and the other end of the fourth slot line 224 is connected to one end of the fifth slot line 225, the other end of the fifth slot line 225 is connected to one end of the sixth slot line 226 and the fifth slot line extends to the second central axis cd. The fourth slot line 224 and the sixth slot line 226 are parallel to each other and both are perpendicular to the fifth slot line 225, where the length of the sixth slot line 226 is shorter than the fourth slot line 224. Therefore, the fourth slot line 224, the fifth slot line 225 and the sixth slot line 226 form a U shape or quasi U shape. It can be understood that if the second defected ground unit 22 is provided with quasi U-shape, more slot lines can be included to form bending sections with very small length, making the second defected ground unit 22 remain with a structure similar to U-shaped as a whole so as to keep the main performance substantially.

If the second defected ground unit 22 is provided with an L-shape or quasi L-shape, the second defected ground unit 22 also can be provided with an L-shaped or quasi L-shaped structure by means of corresponding slot lines.

Specifically, a first electrode plate 31 is formed by the metal dielectric substrate enclosed by part of the first slot line 211, and the second slot line 212 or the third slot line 213 located at a same side of the first slot line 211, the fourth slot line 224, the fifth slot line 225 and the sixth slot line 226 in a same second defected ground unit 22 located at a same side of the first slot line 211. The first electrode plate 31 is provided with L-shape, number of first electrode plates 31 is two (respectively are the metal dielectric substrate enclosed by the second slot line 212 and the metal dielectric substrate enclosed by the third slot line 213). Two first electrode plates 31 are axially symmetric about the first central axis ab. A second electrode plate 32 is formed by the metal dielectric substrate enclosed by part of the first slot line 211, and the second slot line 212 or the third slot line 213 located at the other side of the first slot line 211, the fourth slot line 224, the fifth slot line 225 and the sixth slot line 226 in a same second defected ground unit 22 located at another side of the first slot line 211. The second electrode plate 32 is provided with L-shape, number of second electrode plates 32 is two (respectively are the metal dielectric substrate enclosed by the second slot line 212 and the metal dielectric substrate enclosed by the third slot line 213), and two second electrode plates 32 are axially symmetric about the first central axis ab.

A first inductor $L_S$ is formed by the metal dielectric substrates which are provided between part of the first slot line 211 and the sixth slot lines 226, since there are four second defected ground units 22, there are four sixth slot lines 226, each of the sixth slot lines 226 could forms a first inductor $L_S$ with corresponding part of the first slot line 211. Therefore, number of first inductors $L_S$ is four. The two metal dielectric substrates, which are located at a same side of the first slot line 211 and form the two first inductors $L_S$ respectively, are interconnected to each other. The metal dielectric substrates used to form first inductors $L_S$ and the metal dielectric substrate used to form first electrode plates 31, which are located at a same side of the first central axis ab, are interconnected to each other. The metal dielectric substrates used to form the first inductor $L_S$ and the metal dielectric substrates used to form second electrode plates 32, which are located at a same side of the first central axis ab, are interconnected to each other.

A second inductor $L_P$ is formed by the metal dielectric substrates located between two fifth slot lines 225 at a same side of the first slot line 211. Since there are two fifth slot lines 225 in each side of the first slot line 211, number of second inductors $L_P$ is two. The metal dielectric substrate used to form the second inductor $L_P$ and the two metal dielectric substrates used to form the two first inductors $L_S$ respectively, which are located at a same side of the first slot line 211, are interconnected to each other, forming a shape of T.

The metal dielectric substrates located at periphery of the defected ground unit 2 form a metal ground plane 11, and the metal dielectric substrates which form the metal ground plane 11 are interconnected to the metal dielectric substrates which form second inductors $L_P$.

A first capacitor $C_M$ is formed by the first electrode plate 31 and the second electrode plate 32 which are located at a same side of the first central axis ab, and a second capacitor $C_C$ is formed between the first electrode plate 31 and the metal ground plane 11 or the second electrode plate 32 and the metal ground plane 11.

Figure 6:
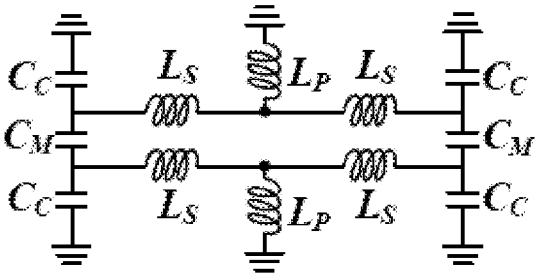
FIG. 6 is an equivalent circuit diagram illustrating a four-mode defected ground structure resonator according to an embodiment of the present invention.

Applying the above structure design, the equivalent circuits of four resonant modes for the four-mode defected ground structure resonator can be extracted. Due to that the shape of the defected ground unit 2 of the four-mode defected ground structure resonator is not only axially symmetric about the first central axis ab, but also is axially symmetric about the second central axis cd, thus the equivalent circuit can be acquired for each of the resonant modes by using odd/even mode theory for two times, specifically as follows:

As shown in FIG. 6, provided is an equivalent circuit for a four-mode defected ground structure resonator according to an embodiment of the present invention. The first central axis ab is equivalent to a short circuit under the odd mode and thus can be seen as a virtual ground plane. When the first central axis ab is equivalent to a short circuit, the current does not pass through the second inductor $L_P$, thus the second inductor $L_P$=0. The first central axis ab is equivalent to an open circuit under the even mode. When the first central axis ab is equivalent to an open circuit, the metal dielectric substrate which forms the second inductor $L_P$ is equivalent to be divided into two halves. The inductor value is relative to the thickness degree of the metal, thus when the first central axis ab is equivalent to an open circuit, the value of the second inductor $L_P$ is twice as many as the value of the original second inductor $L_P$, that is, the value of the current second inductor $L_P$ is 2 $L_P$. Similarly, the second central axis cd is equivalent to a short circuit under the odd mode and thus can be seen as a virtual ground plane. When the second central axis cd is a short circuit, it is equivalent to that the distance between the two plates of the first capacitor $C_M$ is shortened by half. As the capacitance value is relative to the distance between the plates, when the second central axis cd equals to a short circuit, the value of the first capacitor $C_M$ is twice as much as the value of the original first capacitor $C_M$, that is, the current value of the first capacitor $C_M$ is $2C_M$. The second central axis cd is equivalent to an open circuit under the even mode, thus there is no charge in the first capacitor $C_M$, and the first capacitor $C_M$=0.

Figure 7:
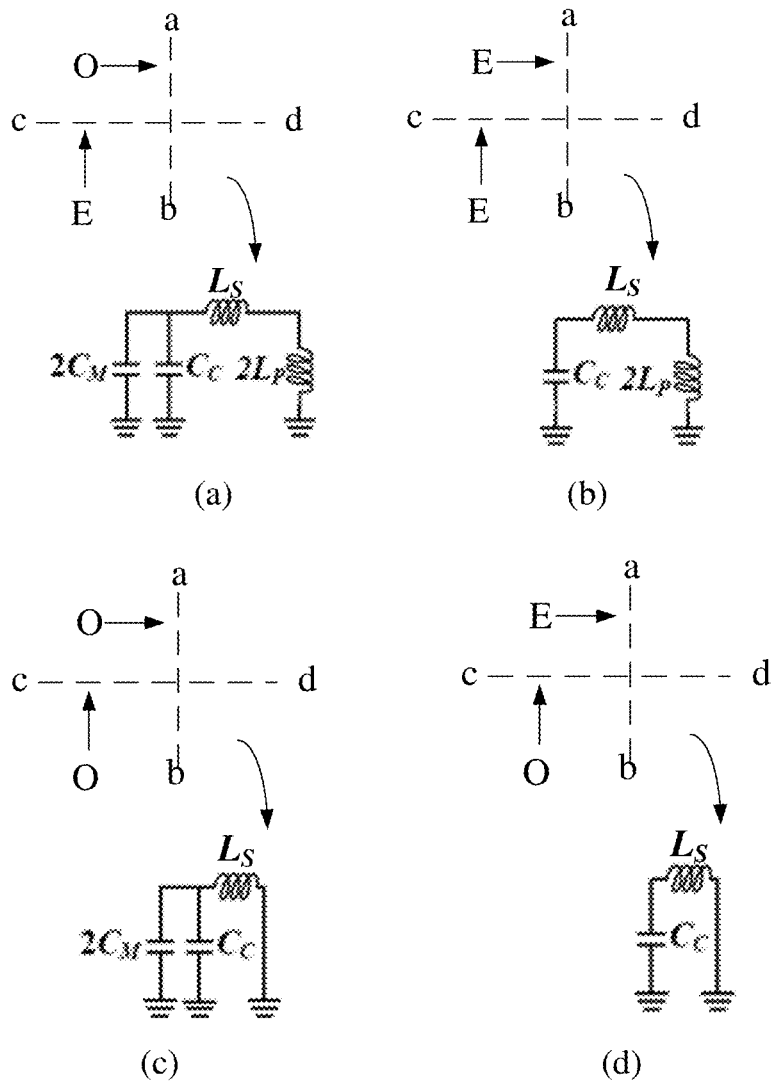
FIG. 7 is an equivalent circuit diagram illustrating four resonant modes of a four-mode defected ground structure resonator according to an embodiment of the present invention, where, (a) is an equivalent circuit diagram of a first resonant mode, (b) is an equivalent circuit diagram of a second resonant mode, (c) is an equivalent circuit diagram of a third resonant mode, (d) is an equivalent circuit diagram of a fourth resonant mode; O indicates that it is an odd mode, and E indicates that it is an even mode.

Resonant frequency is calculated by the formula:

$$f = \frac{1}{2\pi\sqrt{LC}},$$

where L is the inductance value in the circuit and C is the capacitance value in the circuit. Therefore, by applying the above structure design, specifically, resonant frequency of four resonant modes for the four-mode defected ground structure resonator is as follows:

As shown in FIG. 7(*a*), provided is an equivalent circuit of a first resonant mode of a four-mode defected ground structure resonator. When the first central axis ab is under the even mode and the second central axis cd is under the odd mode, the first central axis ab is equivalent to an open circuit and the second central axis cd is equivalent to a short circuit, thus resonant frequency of the first resonant mode is $$f_1 = \frac{1}{2\pi\sqrt{(L_S + 2L_P)(2C_M + C_C)}}.$$

As shown in FIG. 7(*b*), provided is an equivalent circuit of a second resonant mode of a four-mode defected ground structure resonator. When the first central axis ab is under the even mode and the second central axis cd is under the even mode, the first central axis ab is equivalent to an open circuit and the second central axis cd is equivalent to an open circuit, thus resonant frequency of the second resonant mode is $$f_2 = \frac{1}{2\pi\sqrt{(L_S + 2L_P)C_C}}.$$

As shown in FIG. 7(*c*), provided is an equivalent circuit of a third resonant mode of a four-mode defected ground structure resonator. When the first central axis ab is under the odd mode and the second central axis cd is under the odd mode, the first central axis ab is equivalent to a short circuit and the second central axis cd is equivalent to a short circuit, thus resonant frequency of the third resonant mode is $$f_3 = \frac{1}{2\pi\sqrt{L_S(2C_M + C_C)}}.$$

As shown in FIG. 7(*d*), provided is an equivalent circuit of a fourth resonant mode of a four-mode defected ground structure resonator. When the first central axis ab is under the odd mode and the second central axis cd is under the even mode, the first central axis ab is equivalent to a short circuit and the second central axis cd is equivalent to an open circuit, thus resonant frequency of the fourth resonant mode is $$f_4 = \frac{1}{2\pi\sqrt{L_S C_C}}.$$

Known from the above calculation of resonant frequency, the resonant frequencies of four resonant modes for the four-mode defected ground structure resonator of the present invention can be adjusted by adjusting the values of $C_C$, $C_M$, $L_S$ and $L_P$ correspondingly. Since the capacitance value is relative to the area of the plates and the distance between the plates, and the inductance value is relative to the length and thickness of the metal lines, the values of $C_C$, $C_M$, $L_S$ and $L_P$ can be accordingly adjusted by adjusting the sizes of each portion of the defected ground unit 2, thus the good tunability of resonant frequency of four resonant modes for the four-mode defected ground structure resonator is realized. The length of the first slot line 211 is $L_1$, and the width of the first slot line 211 is $W_1$. The second slot line 212 and the third slot line 213 are provided with equal length which is $L_2$. The second slot line 212 and the third slot line 213 are provided with equal width which is $W_2$. The length of the fourth slot line 224 is $L_4$, and the width of the fourth slot line 224 is $W_4$. The length of the fifth slot line 225 is $L_5$, the length of the sixth slot line 226 is $L_6$, and the width of the sixth slot line 226 is $W_6$. The distance between two fifth slot lines 225 which are located at a same side of the first slot line 211 is $S_1$. The distance between the first slot line 211 and the sixth slot line 226 is $S_2$. Resonant frequency of four resonant modes can be accordingly adjusted by adjusting the above said sizes. For example, the value of the first capacitor $C_M$ mainly depends on $W_1$, i.e. the distance between the first electrode plate 31 and the second electrode plate 32. The value of the second capacitor $C_C$ depends on the area of the first electrode plate 31 and the second electrode plate 32 and also the distances between the two plates and the metal ground plane, thus the value of the second capacitor $C_C$ is affected by $L_2$, $L_5'$ ($L_5'=L_5-W_4-W_6$), $L_6$, $W_2$ and $W_4$, the size of the first electrode plate 31 or the second electrode plate 32 of the second capacitor $C_C$ is depended on the former three parameters, and the distance between the first electrode plate 31 of the second capacitor $C_C$ and the metal ground plane 11 or the second electrode plate 32 of the second capacitor $C_C$ and the metal ground plane 11 is depended on the latter two parameters. The value of the first inductor $L_S$ mainly depends on $L_5'$, $L_6$, $W_1$ and $S_2$. The value of the second inductor $L_P$ mainly depends on $L_5'$, $L_6$, $W_1$ and $S_1$.

Figure 8:
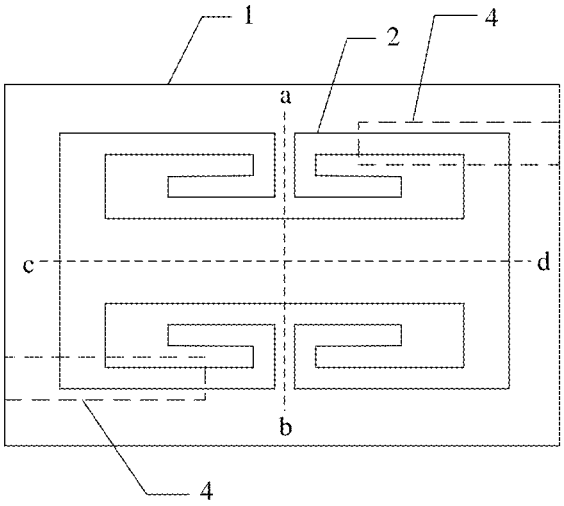
FIG. 8 is a first schematic structural diagram illustrating a four-mode defected ground structure filter according to an embodiment of the present invention.
Figure 9:
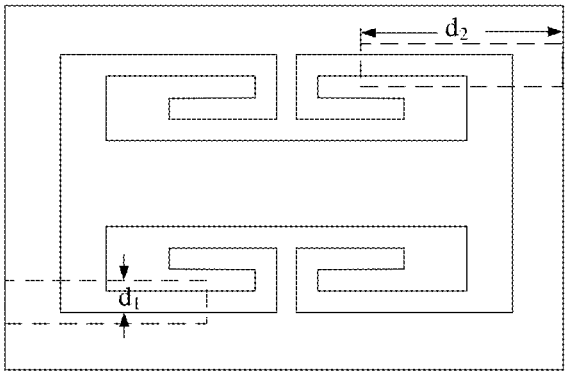
FIG. 9 is a second schematic structural diagram illustrating a four-mode defected ground structure filter according to an embodiment of the present invention.

The present invention further discloses a four-mode defected ground structure filter. As shown in FIG. 8 and FIG. 9, provided are the first and second schematic structural diagrams of the four-mode defected ground structure filters according the embodiments of the present invention respectively.

The four-mode defected ground structure filter includes the above said four-mode defected ground structure resonator and two microstrip feed lines 4. The microstrip feed lines 4 are arranged at another surface of the metal dielectric substrate 1.

The microstrip feed lines 4 feed the defected ground structure resonator at the another surface of the metal dielectric substrate 1. There is no limitation to the location and length of the microstrip feed lines 4, as long as the electromagnetic-energy coupling between the microstrip feed lines 4 and the resonator can be achieved.

The microstrip feed lines 4 can be perpendicular to the defected ground unit 2, or can also be provided at a certain angle to the defected ground unit 2.

The two microstrip feed lines 4 can be both parallel to the second central axis cd. One end of each of the two microstrip feed lines 4 extends to the edges of the metal dielectric substrate 1 respectively, and, the other end of each of the two microstrip feed lines 4 extends from the two corners in the diagonal line of the defected ground unit 2 to the first central axis ab and terminates at the location closing to the closed mouth of the L-shape, quasi L-shape, U-shape or quasi U-shape of the second defected ground unit 22 respectively. It would be appreciated that because there is no limitation to the length of the microstrip feed line 4, as long as the microstrip feed lines 4 and the defected ground unit 2 can be at least partially overlapped in any direction. For example, since the microstrip feed lines 4 and the defected ground unit 2 are located at the two opposite surfaces of the metal dielectric substrate 1 respectively, the microstrip feed lines 4 and the defected ground unit 2 can be overlapped in vertical direction.

By applying the above mentioned structure design, in addition to enabling four resonant modes of the four-mode defected ground structure filter be provided with good tunability, transmission zeros can be generated owing to the coupling between the four-mode defected ground structure resonator and the microstrip feed line 4, thus the four-mode defected ground structure filter can be provided with high upper-passband selectivity and high upper-stopband rejection The locations of the microstrip feed lines 4 are corresponding to the locations of the fourth slot lines 224. The width of the microstrip feed lines 4 is wider than the fourth slot line 224, thus making the microstrip feed lines 4 cover parts of the fourth slot line 224. The other end of the microstrip feed lines 4 terminates at a location closing to the fifth slot line 225 but does not touch the fifth slot line 225. The impedance of the microstrip feed lines 4 is 50Ω. The width of the microstrip feed lines 4 is $W_0$. The distance between the edge of the microstrip feed lines 4 closing to the second central axis cd and the edge of the fourth slot line 224 away from the second central axis cd is $d_1$. The length of the section of microstrip feed lines 4 that covers part of the fourth slot line 224 is $d_2$. It would be appreciated that the above mentioned is merely a technical solution, the microstrip feed lines 4 do not need to terminate at the position closing to the fifth slot line 225, however it can also cover the fifth slot line 225.

As to the four-mode defected ground structure filter of the present invention, the lower cut-off frequency can be effectively adjusted by adjusting $S_1$, and the upper cut-off frequency can be effectively adjusted by changing $L_6$. Since there are different coupling strengths between the microstrip feed lines 4 and the third resonant mode or the fourth resonant mode, thus the first transmission zero $f_{Z1}$ is closed to the fourth resonant mode. Additionally, since the coupling between the microstrip feed lines 4 and the four-mode defected ground structure filter generate the second transmission zero $f_{Z2}$, the size of the $f_{Z2}$ can be easily adjusted by adjusting the length of the microstrip feed lines 4. Along with the increase of $d_2$, resonant frequency of $f_{Z2}$ decreases, meanwhile there is no significant change for $f_{Z1}$, thus, by using this point, the upper-stopband rejection of the second zero can be effectively adjusted.

In the following, characters of the four-mode defected ground structure resonator and filter of the present invention will be verified specifically according to the specific embodiments. In the following embodiments, the transmission response of the four-mode defected ground structure resonator and filter in the condition of weak coupling is simulated by using the Rodgers RO4350B board, where the dielectric constant, the thickness and the loss factor of the metal dielectric substrate are 3.48, 0.762 mm and 0.004 respectively.

First Embodiment

The sizes of each part of the defected ground unit in the first embodiment are as follows: $W_2$=0.4 mm, $W_4$=$W_6$=0.4 mm, $L_1$=22.8 mm, $L_2$=9.4 mm, $L_4$=13.7 mm, $L_5'=L_5-W_4-W_6$=0.8 mm, $L_6$=5.8 mm, $S_1$=0.6 mm and $S_2$=0.3 mm. The $W_1$ in the first embodiment are 1 mm, 3 mm and 5 mm respectively.

Figure 10:
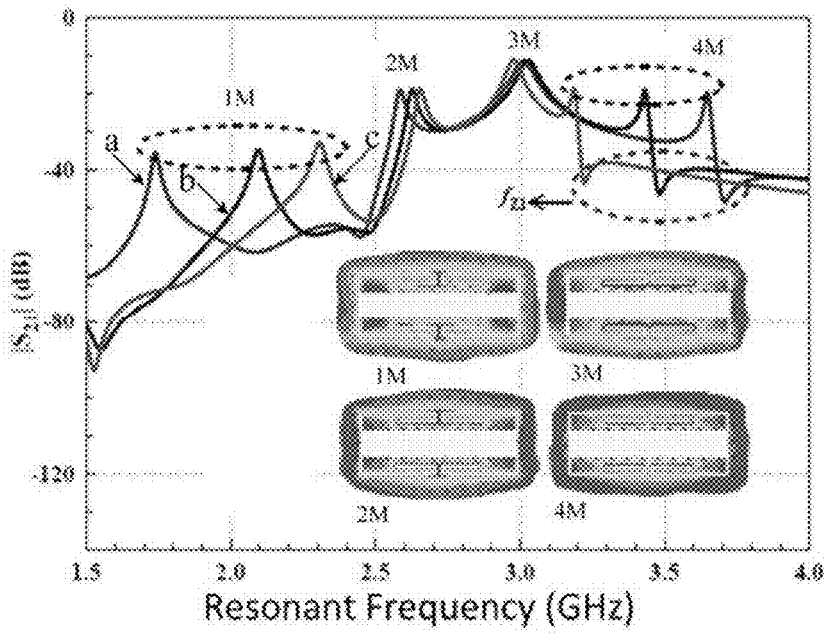
FIG. 10 is a schematic diagram illustrating a weak coupling transmission response of a four-mode defected ground structure resonator and filter vary with a width of a first slot line and a current distribution map based on an electromagnetic simulation software (HFSS) according to a first embodiment of the present invention, where "a" indicates $W_1$=1 mm, "b" indicates $W_1$=3 mm, "c" indicates $W_1$=5 mm, 1M refers to a first resonant mode, 2M refers to a second resonant mode, 3M refers to a third resonant mode and 4M refers to a fourth resonant mode.

As shown in FIG. 10, provided is a schematic diagram illustrating a weak coupling transmission response of a four-mode defected ground structure resonator and filter vary with a width of a first slot line and a current distribution map based on an HFSS according to a first embodiment of the present invention. As can be seen from FIG. 10, along with the increase of $W_1$, resonant frequency of the first resonant mode gradually approaches to resonant frequency of fourth resonant mode, meanwhile, resonant frequency of the second resonant mode and of the third resonant mode almost keeps unchanged. This change is mainly because that, in the condition of that the other sizes of the defected ground unit keep unchanged, along with the increase of $W_1$, the first inductor $L_S$ becomes thinner, thus the value of the first inductor $L_S$ increases; the distance of the first capacitor $C_M$ becomes larger, the area of the second capacitor $C_C$ becomes smaller, thus the values of the first capacitor $C_M$ and the second capacitor $C_C$ decrease. FIG. 10 also shows the current distributions of the four-mode defected ground structure resonant modes in the context of the resonant frequencies of four resonant modes. It can be obviously observed from the current distribution conditions that, under the first and the second resonant mode, the current passes through the first inductor $L_S$ and the second inductor $L_P$ from one side of the metal dielectric substrate and then flows into the metal ground plane; and, under the third and the four resonant mode, the current only passes through the first inductor $L_S$. It can be seen further from the figure that the first transmission zero $f_{Z1}$ approaches to the fourth resonant mode owing to the different coupling strengths between the microstrip feed lines and the third resonant mode or between the microstrip feed lines and the fourth resonant mode.

From the description of embodiment 1, in the condition of that the other sizes of the defected ground unit are kept unchanged, the resonant frequencies of the first resonant mode and the fourth resonant mode can be adjusted by changing the width $W_1$ of the first slot line but keeping the resonant frequencies of the second and the third resonant mode almost not be affected.

Second Embodiment

The sizes of each part of the defected ground unit in the second embodiment are as follows: $W_1$=4 mm, $W_4$=$W_6$=0.4 mm, $L_1$=22.8 mm, $L_2$=9.4 mm, $L_4$=13.7 mm, $L_5'$=$L_5$−$W_4$−$W_6$=0.8 mm, $L_6$=5.8 mm, $S_1$=0.6 mm and $S_2$=0.3 mm. The $W_2$ in the second embodiment are 0.4 mm, 1.0 mm and 4.0 mm respectively.

Figure 11:
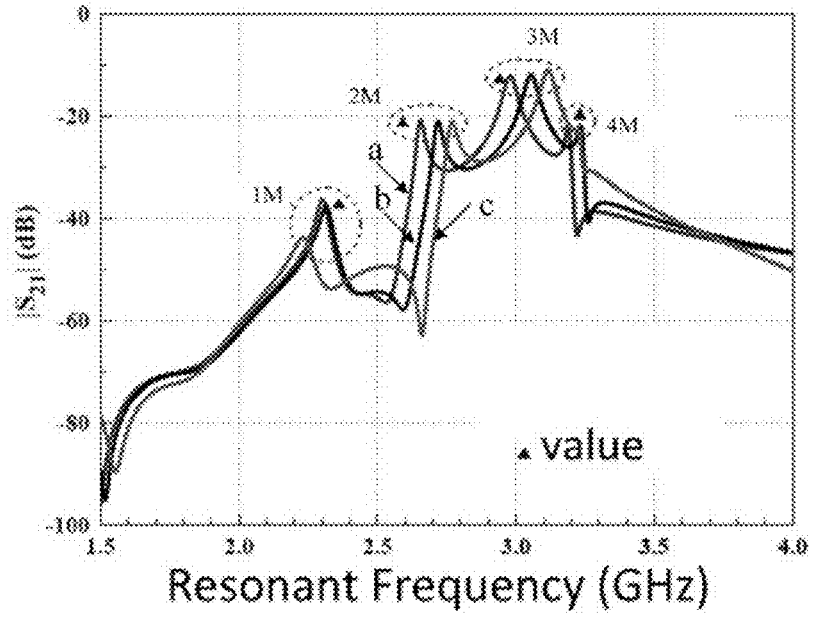
FIG. 11 is a schematic diagram illustrating a weak coupling transmission response of a four-mode defected ground structure resonator and filter vary with a width of a second slot line according to a second embodiment of the present invention, where "a" indicates $W_2$=0.4 mm, "b" indicates W2=1.0 mm, "c" indicates $W_2$=4.0 mm, 1M refers to a first resonant mode, 2M refers to a second resonant mode, 3M refers to a third resonant mode and 4M refers to a fourth resonant mode.

As shown in FIG. 11, provided is a schematic diagram illustrating a weak coupling transmission response of a four-mode defected ground structure resonator and filter vary with a width of a second slot line according to a second embodiment of the present invention. As can be seen from the FIG. 11, the resonant frequencies of the second and the third resonant mode can be easily adjusted by changing $W_2$. The second resonant mode and the third resonant mode move towards high frequency evidently with the increase of $W_2$. This phenomenon is mainly because, along with the increase of $W_2$, the distance between the first electrode plate and the metal ground plane or between the second electrode plate and the metal ground plane also increases, thus the value of $C_C$ decreases.

From the description of the second embodiment, in the condition of that the other sizes of the defected ground unit are kept unchanged, the resonant frequencies of the first resonant mode and the fourth resonant mode can be adjusted by changing the width $W_2$ of the first slot line but keeping the resonant frequencies of the second and the third resonant mode almost not be affected at a same time.

Third Embodiment

The sizes of each part of the defected ground unit in the third embodiment are as follows: $W_1$=4 mm, $W_2$=0.4 mm, $W_4$=$W_6$=0.4 mm, $L_1$=22.8 mm, $L_2$=9.4 mm, $L_4$=13.7 mm, $L_5'$=$L_5$−$W_4$−$W_6$=0.8 mm, $L_6$=5.8 mm and $S_2$=0.3 mm. The $S_1$ of the third embodiment are 0.3 mm, 0.6 mm and 1.0 mm respectively.

Figure 12:
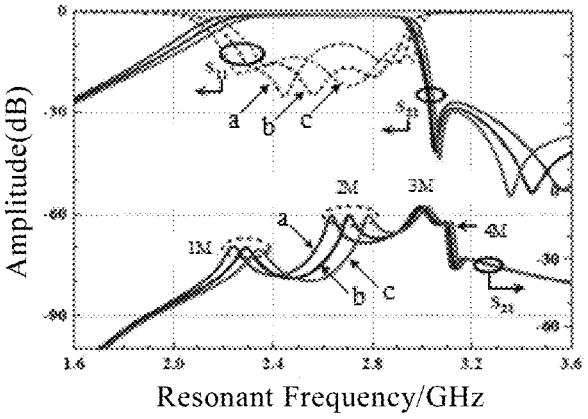
FIG. 12 is a schematic diagram illustrating a weak coupling transmission response of a four-mode defected ground structure resonator and filter vary with a distance between two fifth slot lines which are located at a same side of a first slot line according to a third embodiment of the present invention, where "a" indicates $S_1$=0.3 mm, "b" indicates $S_1$=0.6 mm, "c" indicates $S_1$=1.0 mm, 1M refers to a first resonant mode, 2M refers to a second resonant mode, 3M refers to a third resonant mode and 4M refers to a fourth resonant mode.

As shown in FIG. 12, provided is a schematic diagram illustrating a weak coupling transmission response of a four-mode defected ground structure resonator and filter vary with a distance between two fifth slot lines which are located at a same side of a first slot line according to a third embodiment of the present invention. As can be seen from the FIG. 12, the value of the second inductor $L_P$ can be well adjusted independently by changing $S_1$. Only the first resonant mode and the second resonant mode move towards high frequency with the increase of $S_1$, this is because the increase of $S_1$ makes the second inductor $L_P$ become thicker, thereby the value of $L_P$ is significantly affected, but other sizes are less affected. Since only the first resonant mode and the second resonant mode would move towards a higher frequency with the increase of $S_1$, the lower cut-off frequency can be effectively adjusted by adjusting $S_1$.

From the description of the third embodiment, in the condition of that the other sizes of the defected ground unit are kept unchanged, by changing the value of distance $S_1$ between two fifth slot lines located at a same side of the first slot line, the resonant frequencies of the first resonant mode and the second resonant mode can be adjusted but keeping the resonant frequencies of the third and the fourth resonant mode be almost not affected at a same time, and the lower cut-off frequency can be effectively adjusted further.

Fourth Embodiment

The sizes of every part of the defected ground unit in the fourth embodiment are as follows: $W_1$=4 mm, $W_2$=0.4 mm, $W_4$=$W_6$=0.4 mm, $L_1$=22.8 mm, $L_2$=9.4 mm, $L_4$=13.7 mm, $L_5'$=$L_5$−$W_4$−$W_6$=0.8 mm, $S_1$=0.6 mm and $S_2$=0.3 mm. The $L_6$ in the fourth embodiment are 5.0 mm, 5.8 mm, 6.5 mm and 7.0 mm respectively.

Figure 13:
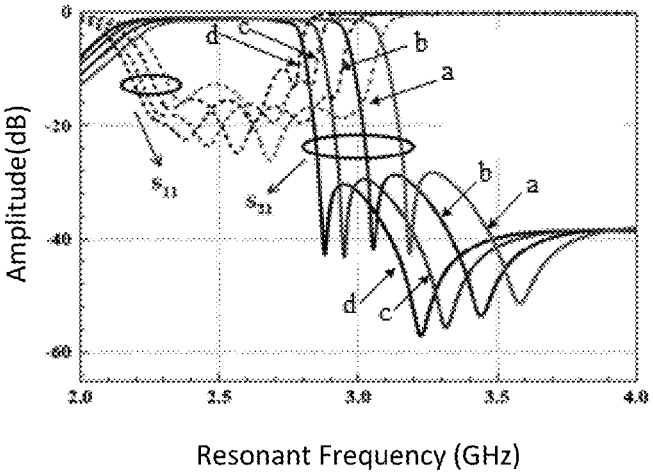
FIG. 13 is a schematic diagram illustrating a weak coupling transmission response of a four-mode defected ground structure resonator and filter vary with length of a sixth slot line according to a fourth embodiment of the present invention, where "a" indicates $L_6$=5.0 mm, "b" indicates $L_6$=5.8 mm, "c" indicates $L_6$=6.5 mm and "d" indicates $L_6$=7.0 mm.

As shown in FIG. 13, provided is a schematic diagram illustrating a weak coupling transmission response of a four-mode defected ground structure resonator and filter vary with length of a sixth slot line according to a fourth embodiment of the present invention. As can be seen from FIG. 13, the upper cut-off frequency can be effectively adjusted by changing $L_6$. This is mainly because the length of first inductor $L_S$ increases along with the increase of $L_6$, then the value of the first inductor $L_S$ increases greatly, however the length increase of $L_S$ generates very small influence to the area of the plates, therefore, the values of the first capacitor $C_M$ and the second capacitor $C_C$ are only decreased by very small fraction. Thus, the change in resonant frequencies of the second, the third and the fourth resonant mode are more substantial in relative to resonant frequency of the first resonant mode, therefore, the upper cut-off frequency can be adjusted effectively.

From the description of the fourth embodiment, in the condition of that the other sizes of the defected ground unit are kept unchanged, the lower cut-off frequency can be adjusted effectively by changing the length size $L_6$ of the sixth slot line.

Fifth Embodiment

The sizes of each part of the defected ground unit in the fifth embodiment are as follows: $W_1$=4 mm, $W_2$=0.4 mm, $W_4$=$W_6$=0.4 mm, $L_1$=22.8 mm, $L_2$=9.4 mm, $L_4$=13.7 mm, $L_5'$=$L_5$−$W_4$−$W_6$=0.8 mm, $L_6$=5.8 mm, $S_1$=0.6 mm and $S_2$=0.3 mm. The $d_2$ of the microstrip feed line in the fifth embodiment are 10.2 mm, 11.2 mm, 11.7 mm and 12.2 mm respectively.

Figure 14:
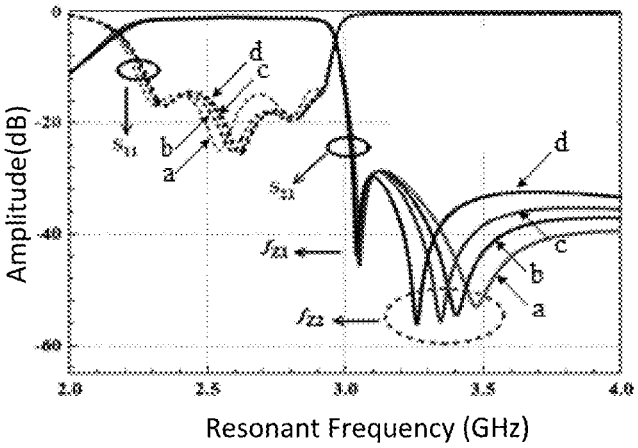
FIG. 14 is a schematic diagram illustrating a weak coupling transmission response of a four-mode defected ground structure resonator and filter vary with length of a microstrip feed line section that covers parts of a fourth slot line according to a fifth embodiment of the present invention, where "a" indicates $d_2$=10.2 mm, "b" indicates $d_2$=11.2 mm, "c" indicates $d_2$=11.7 mm and "d" indicates $d_2$=12.2 mm.

As shown in FIG. 14, provided is a schematic diagram illustrating a weak coupling transmission response of a four-mode defected ground structure resonator and filter vary with length of a microstrip feed line section that covers parts of a fourth slot line according to a fifth embodiment of the present invention. As can be seen from FIG. 14, resonant frequency of $f_{Z2}$ decreases along with the increase of $d_2$, but there is no significant change in $f_{Z1}$ at a same time. By utilizing this point, the upper-stopband rejection of the second transmission zero can be effectively adjusted.

From the description of the fifth embodiment, in the condition of that the other sizes of the defected ground unit are kept unchanged, the upper-stopband rejection of the second zero can be adjusted effectively by changing the size of $d_2$.

Sixth Embodiment

Figure 15:
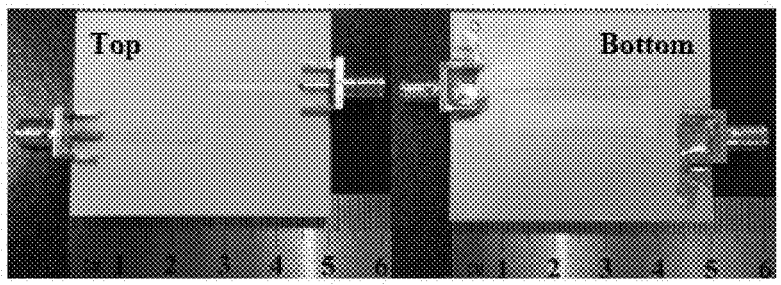
FIG. 15 is an object view illustrating a four-mode defected ground structure filter according to a sixth embodiment of the present invention.

As shown in FIG. 15, provided is an object view of a four-mode defected ground structure filter according to a sixth embodiment of the present invention. The sizes of each part of four-mode defected ground structure filter in the sixth embodiment are as follows: $W_0$=1.7 mm, $W_1$=5.6 mm, $W_2$=3 mm, $W_4$=$W_6$=0.4 mm, $L_1$=22.8 mm, $L_2$=9.4 mm, $L_4$=10.7 mm, $L_5'$=$L_5$—$W_4$–$W_6$=0.8 mm, $L_6$=5.8 mm, $S_1$=0.6 mm, $S_2$=0.3 mm, $d_1$=0.7 mm and $d_2$=10.7 mm.

Figure 16:
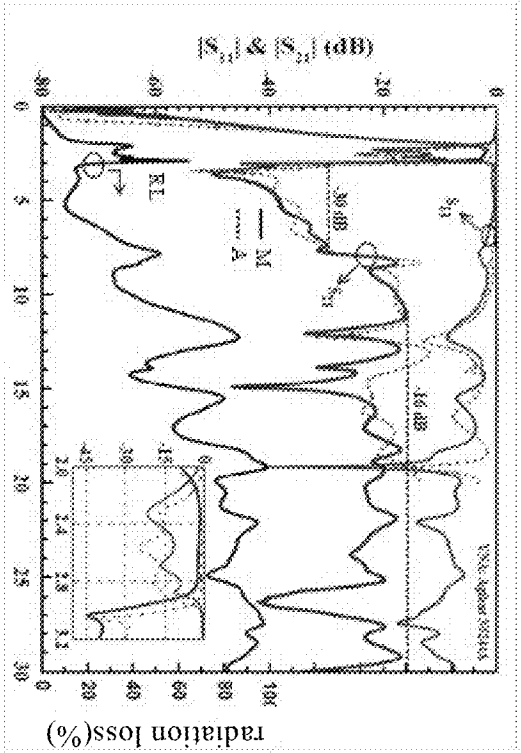
FIG. 16 is a diagram illustrating results of simulating and testing parameter S and radiation loss of a four-mode defected ground structure filter according to a sixth embodiment of the present invention, where M refers to test results and A refers to simulation results.

As shown in FIG. 16, provided is a diagram illustrating results of simulating and testing parameter S and radiation loss of a four-mode defected ground structure filter according to a sixth embodiment of the present invention. It can be seen from the figure that there are two transmission zeros nearby the upper cut-off frequency. The measured central frequency ($f_0$) and the relative bandwidth (FBW) are 2.45 GHz and 32% respectively. The insertion loss (IL) of the central frequency is about 1.98 dB, the width of the upper-stopband is 7.8 GHz ($3.2f_0$) and the upper-stopband rejection is lower than −30 dB. As shown in table 1, provided is the performance comparison between the four-mode defected ground structure filter and the filter in the prior art, where the filter in prior art 1 is the filter according to document 1 (P. Mondal and A. Chakrabarty, "Compact wideband bandpass filters with wide upper stopband," IEEE Microw. Wireless Compon. Lett., vol. 17, no. 1, pp. 31-33, January 2007), the filter in prior art 2 is the filter according to document 2 (P. Mondal, M. Mandal, and A. Chakrabarty, "Compact ultra-wideband bandpass filter with improved upper stopband," IEEE Microw. Wireless Compon. Lett., vol. 17, no. 9, pp. 643-645, September 2007), the filter in prior art 3 is the filter according to document 3 (B. Peng, S. Li, B. Zhang, and S. Wang, "Compact multimode bandpass filters with wide upper stopband using dual-mode dgs resonators," Proc. Asia-Pacific Microw. Conf. 2014, pp. 1217-1219, November 2014), the filter in prior art 4 is the filter according to document 4 (H. Liu, L. Shen, Y. Jiang, X. Guan, S. Wang, L. Shi, and D. Ahn, "Triplemode bandpass filter using defected ground waveguide," Electron. Lett., vol. 47, no. 6, pp. 388-389, March 2011) and the filter in prior art 5 is the filter according to document 5 (A. Ebrahimi, W. Withayachumnankul, S. Al-Sarawi, and D. Abbott, "Compact dual-mode wideband filter based on complementary split-ring resonator," IEEE Microw. Wireless Compon. Lett., vol. 24, no. 3, pp. 152-154, March 2014). Compared to the other related filters in the table 1, the upper-passband selectivity of four-mode defected ground structure filter in the present invention is up to 302 dB/GHz, and the stopband rejection is lower than −16 dB when the frequency is 30 GHz ($12.2f_0$), thus, the four-mode defected ground structure filter in the sixth embodiment is provided with good performance as to the upper-passband selectivity and the harmonic suppression. The simulation and the measuring results show much consistence. The IL and FBW nearby the upper cut-off frequency are mainly caused by the deviation in construction and the error of the connection pieces.

TABLE 1

Performance Comparison of the Four-mode Defected ground structure Filter and the Filter in the Prior Art

| | $f_0$ (GHz) | FBW (%) | IL@$f_0$ (dB) | Brush selectivity for the upper cut-off frequency (dB/GHz) | Out of band rejection when the stopband frequency is 3.2 $f_0$ (dB) |
|---|---|---|---|---|---|
| Prior Art 1 | 2.3 | 56.3 | <1.2 | 30 | 40 |
| Prior Art 2 | 6.64 | 116 | <1.43 | 25 | 22 |
| Prior Art 3 | 2.0 | 24.8 | 2.1 | 82 | 33 |
| Prior Art 4 | 3.5 | 16 | >1.9 | 260 | <10 |
| Prior Art 5 | 2.23 | 62 | <0.27 | 110 | <20 |
| Embodiment 6 | 2.45 | 32 | 1.98 | 302 | 30 |

In summary, a new type of four-mode defected ground structure resonator is designed according to the present invention, the resonator is provided with four resonant modes, and four resonant modes are all provided with good tunability. The resonant frequencies of four resonant modes can be conveniently adjusted by changing corresponding sizes of the resonator. The present invention also constructs a new type of four-mode defected ground structure filter based on the four-mode defected ground structure resonator. The four-mode defected ground structure filter is provided with good upper-passband selectivity and out-of-band rejection. The design parameters of the four-mode defected ground structure filter can be easily determined according to the designing curve graphs of four resonant modes and the transmission zeros.

Above mentioned are the detailed instructions of the technical solution of the present invention. Specific examples are utilized in the document to illustrate the principle and implementations of the present invention, and the description of the above mentioned embodiments are only used to help interpret the core concept of the present invention. Furthermore, for a person skilled in the art, there would be changes to specific implementations and application scope according to the concept of the embodiments of the present invention. In summary, the content of the present description should not be interpreted as a limit to the embodiments of the present invention.

What is claimed is:

1. A four-mode defected ground structure resonator, comprising a metal dielectric substrate and a defected ground unit which is etched in one surface of the metal dielectric substrate, wherein the defected ground unit has a shape that is axially symmetric about a first central axis of the defected ground unit, and is axially symmetric about a second central axis of the defected ground unit, and the first central axis and the second central axis are mutually perpendicular; the defected ground unit comprises a first defected ground unit and four second defected ground units, wherein the first defected ground unit is H-shaped or quasi H-shaped, each of the second defected ground units is L-shaped, quasi L-shaped, U-shaped or quasi U-shaped, one end of each of the four second defected ground units is connected to four ends of the first defected ground unit respectively, each of the second defected ground units extends from the first defected ground unit to the first central axis and bends to a center of the defected ground unit, openings of the four second defected ground units are each L-shaped, quasi L-shaped, U-shaped or quasi U-shaped, the openings all face towards a periphery of the defected ground unit, and, there is a space provided between two of the second defected ground units which are located at a same side of the first central axis or a same side of the second central axis.

2. The four-mode defected ground structure resonator according to claim 1, wherein, the first defected ground unit is formed by a first slot line, a second slot line and a third slot line; one end of the first slot line is connected to a middle part of the second slot line, the other end of the first slot line is connected to a middle part of the third slot line; and the second slot line and the third slot line are parallel to each other and both are perpendicular to the first slot line.

3. The four-mode defected ground structure resonator according to claim 2, wherein, when each of the second defected ground units is U-shaped or quasi U-shaped, each of the second defected ground units comprises a fourth slot line, a fifth slot line and a sixth slot line, wherein, one end of the fourth slot line is connected to any end of the second slot line or the third slot line and extends to the first central axis; the other end of the fourth slot line is connected to one end of the fifth slot line, the other end of the fifth slot line is connected to one end of the sixth slot line and extends to the second central axis; and, the fourth slot line and the sixth slot line are parallel to each other and both are perpendicular to the fifth slot line.

4. The four-mode defected ground structure resonator according to claim 3, wherein, a length of the sixth slot line is shorter than that of the fourth slot line.

5. The four-mode defected ground structure resonator according to claim 3, wherein a first electrode plate is formed by a part of the metal dielectric substrate enclosed by part of the first slot line, the second slot line or the third slot line located at a same side of the first slot line, the fourth slot line, the fifth slot line and the sixth slot line, wherein, the first electrode plate is L-shaped, a number of first electrode plates is two, and the two first electrode plates are axially symmetric about the first central axis;

a second electrode plate is formed by a part of the metal dielectric substrate enclosed by part of the first slot line, the second slot line or the third slot line located at another side of the first slot line, the fourth slot line, the fifth slot line and the sixth slot line, wherein, the second electrode plate is L-shaped, a number of second electrode plates is two, and the two second electrode plates are axially symmetric about the first central axis.

6. The four-mode defected ground structure resonator according to claim 5, wherein four parts of the metal dielectric substrate provided between part of the first slot line and the sixth slot line form four first inductors $L_s$respectively; two of the four parts of the metal dielectric substrate, which are located at a same side of the first slot line and form two of the first inductors $L_s$ respectively, are interconnected to each other; the part of the metal dielectric substrate forming the first electrode plate and two of the four parts of the metal dielectric substrates forming the first inductor $L_s$ and located at a same side of the first central axis are interconnected to each other; and the part of the metal dielectric substrate forming the second electrode plate and the other two parts of the metal dielectric substrate forming the first inductor $L_s$ and located at a same side of the first central axis are interconnected to each other.

7. The four-mode defected ground structure resonator according to claim 6, wherein two parts of the metal dielectric substrate located between fifth slot lines of two of the second defected ground units at a same side of the first slot line form two second inductors $L_p$; two parts of the metal dielectric substrate respectively forming two first inductors $L_s$ and one of the two parts of the metal dielectric substrate forming second inductors $L_p$ and located at a same side of the first slot line are interconnected to each other, and form a T-shape.

8. The four-mode defected ground structure resonator according to claim 7, wherein, a part of the metal dielectric substrate located at the periphery of the defected ground unit forms a metal ground plane, and the part of the metal dielectric substrate forming the metal ground plane and the parts of the metal dielectric substrate forming second inductors $L_p$are interconnected to each other.

9. The four-mode defected ground structure resonator according to claim 8, wherein a first capacitor $C_M$ is formed by the first electrode plate and the second electrode plate which are located at a same side of the first central axis, a second capacitor $C_c$ is formed between the metal ground plane and the first electrode plate or the second electrode plate.

10. The four-mode defected ground structure resonator according to claim 9, wherein a resonant frequency of a first resonant mode of the four-mode defected ground structure resonator is $$f_1 = \frac{1}{2\pi\sqrt{(L_S + 2L_P)(2C_M + C_C)}};$$

a resonant frequency of a second resonant mode of the four-mode defected ground structure resonator is $$f_2 = \frac{1}{2\pi\sqrt{(L_S + 2L_P)C_C}};$$

a resonant frequency of a third resonant mode of the four-mode defected ground structure resonator is $$f_3 = \frac{1}{2\pi\sqrt{L_S(2C_M + C_C)}};$$

and, a resonant frequency of a fourth resonant mode of the four-mode defected ground structure resonator is $$f_4 = \frac{1}{2\pi\sqrt{L_S C_C}}.$$

* * * * *